US005138997A

United States Patent [19]

Fehlmann

[11] Patent Number: 5,138,997

[45] Date of Patent: Aug. 18, 1992

[54] FUEL INJECTION PUMP FOR INTERNAL COMBUSTION ENGINES

[75] Inventor: Wolfgang Fehlmann, Stuttgart, Fed. Rep. of Germany

[73] Assignee: Robert Bosch GmbH, Stuttgart, Fed. Rep. of Germany

[21] Appl. No.: 646,743

[22] PCT Filed: Jun. 1, 1990

[86] PCT No.: PCT/DE90/00416

§ 371 Date: Jan. 22, 1991

§ 102(e) Date: Jan. 22, 1991

[87] PCT Pub. No.: WO90/15925

PCT Pub. Date: Dec. 27, 1990

[30] Foreign Application Priority Data

Jun. 22, 1989 [DE] Fed. Rep. of Germany ..... 3920459

[51] Int. Cl.[5] ..... F02M 39/00

[52] U.S. Cl. ..... 123/449; 123/494; 123/495; 73/119 A

[58] Field of Search ..... 123/494, 449, 495, 502, 123/503; 73/119 A

[56] References Cited

U.S. PATENT DOCUMENTS

| | | | |
|---|---|---|---|
| 3,758,241 | 9/1973 | Eheim | 123/449 |
| 4,200,074 | 4/1980 | Kosuda | 123/449 |
| 4,367,714 | 1/1983 | DiDomenico | 123/449 |
| 4,470,763 | 9/1984 | Yasuhara | 123/449 |
| 4,561,398 | 12/1985 | Roca Nierga | 123/449 |
| 4,603,669 | 8/1986 | Takemoto | 123/449 |
| 4,656,990 | 4/1987 | Miyaki | 123/494 |

FOREIGN PATENT DOCUMENTS

| | | | |
|---|---|---|---|
| 3336871 | 4/1985 | Fed. Rep. of Germany . | |
| 0065858 | 4/1982 | Japan | 123/449 |
| 0208156 | 11/1984 | Japan | 123/449 |

*Primary Examiner*—Carl S. Miller
*Attorney, Agent, or Firm*—Michael J. Striker

[57] ABSTRACT

A fuel injection pump for internal combustion engines has a pump and distributor plunger (21) actuated by a cam plate (12) performing a rotary lifting movement. The cam plate (12) is coupled to the drive shaft for joint rotation therewith. The cam plate has face cams (14) thereon engaging rollers (16) guided in a substantially stationary roller ring (17). For the purpose of detecting the speed and the radial position of the drive shaft (11), a radial position transmitter is provided which has a transmitter wheel (36) firmly connected in the direction of rotation with the drive shaft (11) and which has a detector (37) scanning the transmitter wheel (36) and fixed in the roller ring (17). The roller ring is held on the drive shaft (11) by a ball bearing (41). Thereby uncontrolled relative movements between detector (37) and transmitter wheel (36) are eliminated, and the angular rotational position as well as the speed of the drive shaft (11) can be detected with a high degree of accuracy.

4 Claims, 1 Drawing Sheet

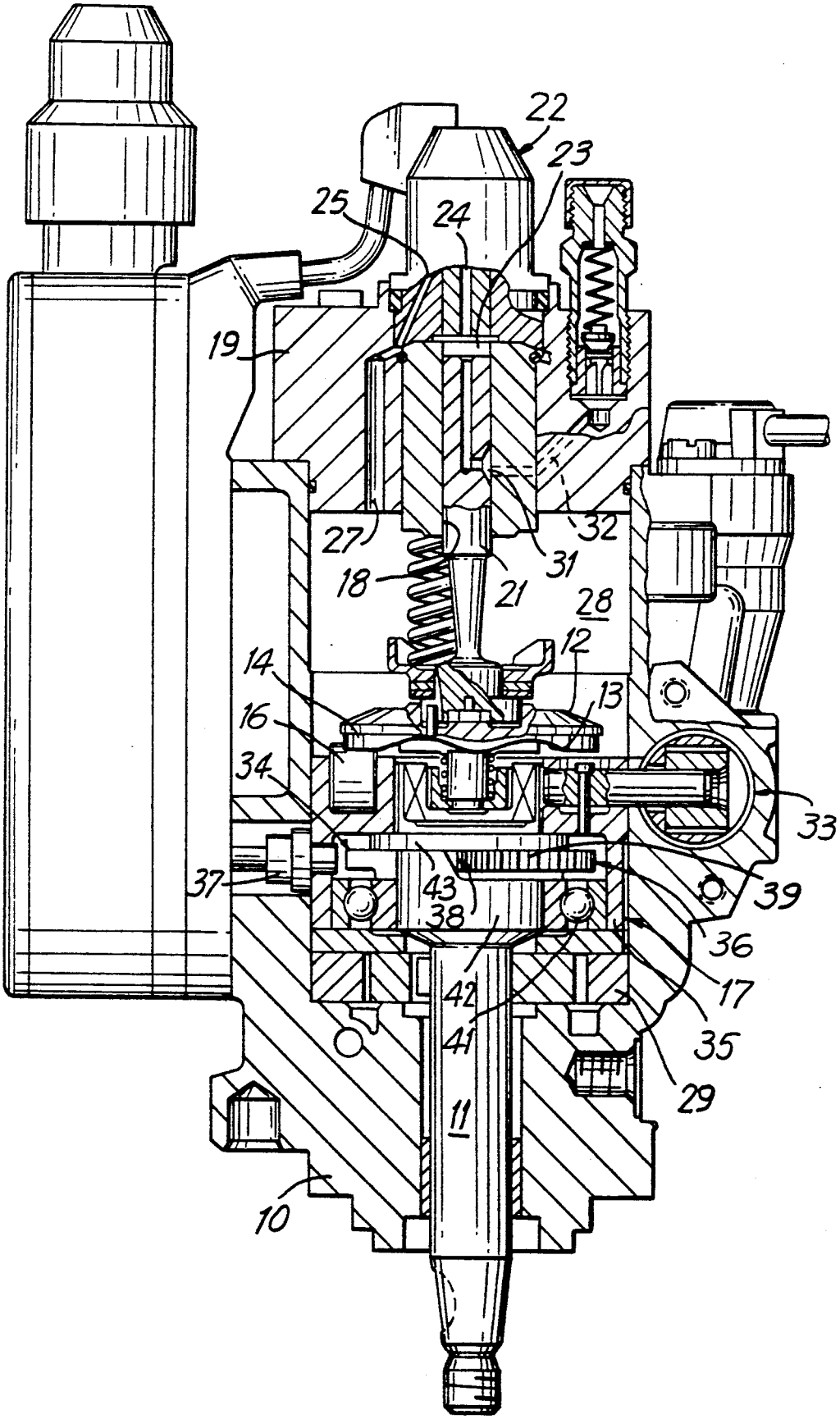
22
23
25
24
19
27
32
31
18
21
28
12
14
13
16
34
33
37
43
39
38
36
42
17
41
35
29
11
10

FUEL INJECTION PUMP FOR INTERNAL COMBUSTION ENGINES

BACKGROUND OF THE INVENTION

The invention relates to a fuel injection pump comprising at least one pump plunger moved by a cam drive formed of a substantially stationary part and of a rotating part driven by a drive shaft. One of the parts has a cam track with several elevations, and another of the parts is rotated relative to the one part by an adjustment device to coordinate the stroke of the pump plunger. A control device controls fuel injection and includes a radial position transmitter having a first transmitter part coupled with the stationary part of the cam drive, and second transmitter parts arranged on the drive shaft or on a part firmly connected in the direction of rotation with the drive shaft.

Such a fuel injection pump is already known from DE-OS 33 36 871. This fuel injection pump has a pump and, distributor plunger as well as a cam plate which imparts to this plunger a rotary lifting movement. The cam plate which is firmly connected in the direction of rotation to a drive shaft receives its lifting movement as a result of rolling contact between face cams on the cam plate and rollers of a stationary roller ring. For the purpose of detecting an angular rotational position and the speed of drive shaft, the fuel injection pump is provided with a rotation transmitter which has marks at the periphery of a part rotating synchronously with the drive shaft and a detector which scans these marks. The detector is fastened to the roller ring which can be rotated by an injection adjusting device for the purpose of adjusting the time of injection. The roller ring and the drive shaft do not bear against each other so that the two parts can make uncontrolled movements relative to each other which are superimposed on the actual rotating movement and thereby falsify the measurement result.

SUMMARY OF THE INVENTION

The object of the invention is a fuel injection pump in which the invention with the uncontrolled relative movements between the rotatable part of the cam drive and the drive shaft are eliminated, and a high degree of accuracy of detection of the speed and the radial position of the drive shaft is achieved. The object of the invention is achieved by providing a bearing between these two parts.

The present invention both as to its construction so to its mode of operation, together with additional objects and advantages thereof, will be best understood from the following detailed description of the preferred embodiments when read with reference to the accompanying drawings.

BRIEF DESCRIPTION OF THE DRAWING

The single FIGURE of the drawing shows a longitudinal cross-sectional view of the fuel injection pump according to the invention.

DESCRIPTION OF THE PREFERRED EMBODIMENT

The figure shows a fuel injection pump of the distributor type for a Diesel internal combustion engine. A drive shaft 11 is supported in a bearing in housing 10 of the fuel injection pump. This drive shaft is coupled with a cam plate 12 arranged at a right angle to the axis of the drive shaft 11 and carrying as a part of a cam drive a cam track 13 with face cam elevations 14. The bearing surface of the cam plate 12 runs on rollers 16 which are held in a roller ring 17 also belonging to the cam drive. The drive is fitted in a cylindrical recess in the housing so that it can rotate and is firmly supported axially relative to the housing by a bottom part of the recess.

The cam plate 12 performs a rotary lifting movement due to the rotationally fixed connection of the cam plate 12 and the drive shaft 11 and due to the rolling of the face cams 14 on the rollers 16.

A pump and distributor plunger, hereinafter referred to briefly as pump plunger 21, sliding in a cylindrical hole 18 of a cylindrical block 19 is coupled with the cam plate 12 and likewise performs a rotary lifting movement. An operating chamber 23 of the pump in the cylindrical block 19 is limited, on one hand, by the pump plunger 21 and on the other hand, by a solenoid valve 22 set in the cylindrical block 19. The operating chamber 23 of the pump can be connected with the inner pump chamber 28 by channels 24 and 25 in the solenoid valve 22 and by a fuel channel 27 in the cylindrical block 19. The passage through the channels 24 and 25 in the solenoid valve 22 may be closed by a valve closing element which is not shown, so that the operating chamber 23 of the pump is separated. The solenoid valve 22 is actuated by a control device which is not shown and the operation of which is dependent on parameters which must be taken into account for the measuring and timing of the fuel injection quantity. The control device may for this purpose contain performance characteristics containing set values for the quantity of fuel to be injected. During the suction stroke of the pump plunger 21 fuel, flows from the inner pump chamber 28 into the operating chamber 23 of the pump through the fuel channel 27 and the channels 24 and 25 in the solenoid valve 22, when the valve is open. The inner pump chamber 28 is supplied with fuel from a fuel container by a vane delivery pump 29 driven by the drive shaft 11.

During the delivery stroke of the pump plunger 21, the passage between the channels 24 and 25 in the solenoid valve 22 is closed at a point of time determined by the control device, and the operating chamber 23 of the pump, is thereby closed so that pressure builds up in the operating chamber 23 of the pump and fuel is forced through an axial relief channel 20 in the pump plunger and a distributor opening 31 connected therewith into a delivery line 32 leading to a cylinder of the internal combustion engine. At a point of time also determined by the control device, the passage between the channels 24 and 25 is reopened and the delivery under pressure to the delivery line 32 is interrupted and the injection terminated. Fuel subsequently delivered by the pump plunger 21 until it reaches its top dead centre then flows back into the inner pump chamber 28 through the channels 24 and 25 as well as through the fuel channel 27.

In addition, an injection adjustment device 33 is provided in the injection pump which advances the time of injection when the speed increases. For this purpose, the injection adjustment device 33 rotationally displaces the roller ring 17 in a peripheral direction so that the lifting movement of the cam plate 12 takes place correspondingly earlier in relation to the rotational angle of the drive shaft 11.

In order to control the solenoid valve 22, the control device requires signals representative of the speed and the angular position of the drive shaft 11. These signals are acquired by a angular position transmitter 34 including a transmitting wheel 36 firmly connected in the direction of rotation with the drive shaft 11. A part of the angular position transmitter 34 constructed as detector 37, is fixed in the roller ring 17 which is provided with a cylindrical carrier 35 with which it encircles the transmitter wheel 36 on the periphery thereof. Affixed on the transmitter wheel 36 is a number of marks 38 corresponding to the number of cylinders of the internal combustion engine. The arrangement of the marks 38 is so chosen that the detector 37 detects one mark 38 at any one time when the drive shaft 11 takes up a specific angular position in which the pump plunger has, for example, reached its bottom dead centre and the delivery stroke of the pump plunger 21 begins. In addition, there are on the transmitter wheel 36 between each two marks 38 also numerous equidistant markings 39. The markings 39 are made clearly distinguishable from the marks 38, for example by different size. The markings 39 are likewise detected by the detector 37, but it is also possible to use a further separate detector to scan the markings 39. The instantaneous speed of the drive shaft 11 is determined with the aid of the markings 39.

The roller ring 17 is connected to the drive shaft 11 by a bearing 41 which is, in this case, in the form of a grooved ball bearing. The bearing 41 is pressed in between the cylindrical carrier 35 of the roller ring 17 and a shank section 42 of the drive shaft 11. The transmitter wheel 36 is fixed between the bearing 41 and a collar 43 of the drive shaft 11. By attaching the detector 37 to the roller ring 17, the coordination between the detector 37 and the stroke movement of the pump plunger 21 is maintained when the time of injection is adjusted, since the detector 37 is rotated together with the roller ring 17. Uncontrolled relative movements between the detector 37 and the transmitter wheel 36 are eliminated by the bearing 41, so that speed and the angular position of the drive shaft 11 can be detected with a high degree of accuracy.

While the invention has been illustrated and described as embodied in a fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injection pump for internal combustion engines, comprising a housing; at least one pump plunger displaceable in said housing; a cam drive for displacing said at least one plunger and including a first element supported in said housing and having a bearing surface; a second element rotatable relative to said first element and having a cam track with elevations thereon cooperating with said bearing surface of said first element for determining a stroke of said at least one plunger; a drive shaft for rotating said second element relative to said first element; adjustment means for rotating said first element relative to said second element in order to vary the coordination of the stroke of said at least one plunger, which is actuated by said elevations, with the rotational angle of said drive shaft; means for generating a signal representative of the rotational angle of said drive shaft and used for controlling injection, said generating means comprising first transmitter means fixedly connected with said drive shaft, and second transmitter means fixedly secured on said first element for generating the representative signal upon scanning said first transmitter means; and bearing means for supporting said first element on said drive shaft to prevent uncontrollable movement of said first element relative to said drive shaft.

2. A fuel injection pump for internal combustion engines, comprising a housing; at least one pump plunger displaceable in said housing; a cam drive for displacing said at least one plunger and including a first element supported in said housing and having a bearing surface; a second element rotatable relative to said first element and having a cam track with elevations thereon cooperating with said bearing surface of said first element for determining a stroke of said at least one plunger; a drive shaft for rotating said second element relative to said first element; adjustment means for rotating said first element relative to said second element in order to vary the coordination of the stroke of said at least one plunger, which is actuated by said elevations, with the rotational angle of said drive shaft; means for generating a signal representative of the rotational angle of said drive shaft and used for controlling injection, said generating means comprising first transmitter means fixedly connected with said drive shaft, and second transmitter means fixedly secured on said first element for generating the representative signal upon scanning said first transmitter means; and bearing means for supporting said first element on said drive shaft to prevent uncontrollable movement of said first element relative to said drive shaft, said first element having a cylindrical carrier, said bearing means being pressed in between said drive shaft and said cylindrical carrier.

3. A fuel injection pump as set forth in claim 1, wherein said bearing means comprises a roller bearing.

4. A fuel injection pump as set forth in claim 1, wherein said bearing means comprises a grooved ball bearing.

* * * * *